US011172793B2

(12) United States Patent
Mueller

(10) Patent No.: US 11,172,793 B2
(45) Date of Patent: Nov. 16, 2021

(54) PAPER ROLL DAMPENER

(71) Applicant: Reinhold Mueller, Bonita, CA (US)

(72) Inventor: Reinhold Mueller, Bonita, CA (US)

( * ) Notice: Subject to any disclaimer, the term of this patent is extended or adjusted under 35 U.S.C. 154(b) by 0 days.

(21) Appl. No.: 16/262,889

(22) Filed: Jan. 30, 2019

(65) Prior Publication Data

US 2019/0231150 A1 Aug. 1, 2019

Related U.S. Application Data

(60) Provisional application No. 62/623,754, filed on Jan. 30, 2018.

(51) Int. Cl.
*A47K 10/38* (2006.01)
*A47K 10/32* (2006.01)

(52) U.S. Cl.
CPC ..... *A47K 10/38* (2013.01); *A47K 2010/3253* (2013.01); *A47K 2010/3863* (2013.01)

(58) Field of Classification Search
CPC ..... A47K 10/38; A47K 2010/3863; A47K 2010/3253; A47K 10/24; A47K 10/32
See application file for complete search history.

(56) References Cited

U.S. PATENT DOCUMENTS

| | | | | | |
|---|---|---|---|---|---|
| 2,612,273 | A * | 9/1952 | Smith | A47K 10/04 | 211/119.009 |
| 4,205,802 | A * | 6/1980 | Economakis | A47K 10/38 | 242/594.5 |
| 5,012,986 | A * | 5/1991 | Needle | A47K 10/38 | 242/560 |
| 5,605,250 | A * | 2/1997 | Meiron | A47K 10/38 | 221/33 |
| 6,378,800 | B1 * | 4/2002 | Apichom | A47K 10/40 | 242/560 |
| 6,460,799 | B1 * | 10/2002 | Ryan | A47K 10/38 | 242/560.2 |
| 6,945,493 | B1 * | 9/2005 | Gottesman | A47K 10/38 | 242/560.2 |
| 2005/0150991 | A1 * | 7/2005 | Priefert | B62B 1/26 | 242/557 |
| 2015/0083743 | A1 * | 3/2015 | D'Angelo | A47K 10/38 | 221/45 |
| 2018/0125308 | A1 * | 5/2018 | Cuenca | A47K 10/22 | |

* cited by examiner

*Primary Examiner* — William A. Rivera
(74) *Attorney, Agent, or Firm* — Enrique Monteagudo, Esq.

(57) ABSTRACT

Aspects of the present disclosure generally pertain to a devices for dampening inadvertent rollout of a paper roll. Generally, the disclosed dampening device for a paper roll is a device that rests on a bottom portion of an inner surface of a paper roll when the paper roll is installed in a horizontal orientation. The dampening device relies on its weight, to provide friction to resist rollout.

19 Claims, 5 Drawing Sheets

PAPER ROLL DAMPENER

CROSS-REFERENCE TO RELATED APPLICATIONS

This application claims priority to U.S. provisional patent application 62/623,754 filed Jan. 30, 2018 entitled PAPER ROLL DAMPENER, the contents of which are incorporated herein by reference in its entirety.

BACKGROUND OF THE INVENTION

Technical Field

The present disclosure generally pertains to dampening devices, and is more particularly directed towards a dampening device for a paper roll.

Related Art

Paper rolls, particularly household paper rolls (e.g., toilet paper and paper towels) are commonly installed on rollers or dispenser bars. The rollers provide a convenient way to unroll or otherwise access the paper rolls. For example, toilet paper rolls are often held or otherwise supported in bathrooms by a horizontal bar. Similarly, paper towel rolls are often held or otherwise supported in kitchens by a horizontal bar. Oftentimes, as a result of an inadvertently hard tug or animal/child interaction, the paper roll may continue rolling out of control, sometimes excessively.

Attempts have been made to resolve this problem, such as weighty metal flaps resting on the outer surface of the paper roll, or friction materials (e.g., collapsible foam) that extends between the dispenser bar and the inner surface (e.g., cardboard tube) of the paper roll that resist rolling motion of the inner surface about the dispenser bar. These attempts may have deficiencies including but not limited to being costly, complicated to install, and short lifespan. As such, an improved solution is desirable.

The present disclosure is directed toward overcoming known problems and problems discovered by the inventor. Further, the present disclosure addresses this problem while mitigating additional costs and complexities.

SUMMARY

Aspects of the present disclosure generally pertain to a devices for dampening inadvertent rollout of a paper roll. Generally, the disclosed dampening device for a paper roll is a device that rests on a bottom portion of an inner surface of a paper roll when the paper roll is installed in a horizontal orientation. The dampening device relies on its weight, providing friction to resist rollout.

A device for inhibiting inadvertent unrolling of a paper roll while horizontally supported on a roller is disclosed herein, where the paper roll has an inner roll surface, said inner roll surface defining a center axis, a first roll end, a second roll end, and a cylindrical volume. The device for inhibiting inadvertent unrolling of a paper roll includes a roll interface configured to be axially inserted into the cylindrical volume of the paper roll while horizontally supported on the roller, and to interface with the inner roll surface of the paper roll with sufficient contact surface and friction to resist an inadvertent rollout of the paper roll, yet allow the device to automatically reset itself to a lowest radial position of the inner roll surface upon being displaced beyond a predetermined threshold; a dampener weight coupled to the roll interface; and a roll retainer coupled to the roll interface, the roll retainer including a first end retainer and a second end retainer, the first end retainer and the second end retainer configured to inhibit axial movement via braking against the first roll end and the second roll end of the paper roll once installed.

According to one embodiment, a toilet paper roll dampener for inhibiting inadvertent unrolling of a toilet paper roll while horizontally supported on a roller is disclosed herein, wherein the toilet paper roll has an inner roll surface, said inner roll surface defining a center axis, a first roll end, a second roll end, and a cylindrical volume, the toilet paper roll dampener includes a roll interface configured to be axially inserted into the cylindrical volume of the toilet paper roll while horizontally supported on the roller, and to interface with the inner roll surface of the toilet paper roll with sufficient contact surface and friction to resist an inadvertent rollout of the toilet paper roll, yet allow the device to automatically reset itself to a lowest radial position of the inner roll surface upon being displaced beyond a predetermined threshold; a dampener weight coupled to the roll interface; and a roll retainer coupled to the roll interface, the roll retainer including a first end retainer and a second end retainer, the first end retainer and the second end retainer configured to inhibit axial movement via braking against the first roll end and the second roll end of the toilet paper roll once installed.

According to another embodiment, a paper towel roll dampener for inhibiting inadvertent unrolling of a paper towel roll while horizontally supported on a roller is disclosed herein, where the paper towel roll has an inner roll surface, said inner roll surface defining a center axis, a first roll end, a second roll end, and a cylindrical volume, the paper towel roll dampener includes a roll interface configured to be axially inserted into the cylindrical volume of the paper towel roll while horizontally supported on the roller, and to interface with the inner roll surface of the paper towel roll with sufficient contact surface and friction to resist an inadvertent rollout of the paper towel roll, yet allow the device to automatically reset itself to a lowest radial position of the inner roll surface upon being displaced beyond a predetermined threshold; a dampener weight coupled to the roll interface; and a roll retainer coupled to the roll interface, the roll retainer including a first end retainer and a second end retainer, the first end retainer and the second end retainer configured to inhibit axial movement via braking against the first roll end and the second roll end of the paper towel roll once installed.

DETAILED DESCRIPTION

Aspects of the present disclosure generally pertain to a devices for dampening inadvertent rollout of a paper roll (e.g., the paper roll continuing to unroll after a user has ceased to pull on a paper sheet of the paper roll). Generally, the disclosed dampening device for a paper roll is a device that rests on a bottom portion of an inner surface of a paper roll when the paper roll is installed in a horizontal orientation. The dampening device relies on its weight to resist rollout.

Aspects of the present disclosure may be preferably embodied as a rod inserted between the dispenser bar and a cardboard tube (e.g., for toilet paper, paper towel, plastic bag roll, wallpaper roll, etc.). The rod may provide sufficient weight (or transfer sufficient weight) so as to create friction against rolling, and thus provide a braking effect to inhibit the unrolling action. The rod may have any convenient cross section, however to reduce costs, a round or rectangular cross section may be preferable.

Figure 1:
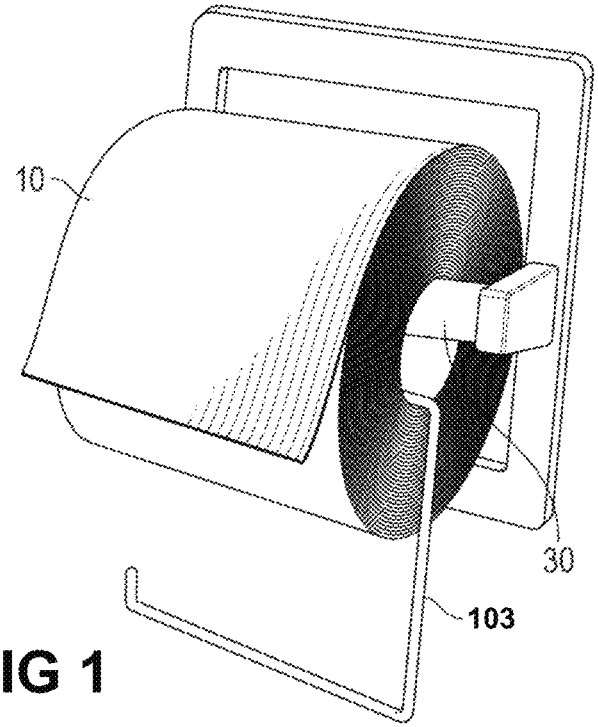
FIG. 1 is a perspective view of a paper roll dampener in an in-use condition, according to an exemplary embodiment of the present disclosure.

FIG. 1 is a perspective view of a paper roll dampener in an in-use condition, according to an exemplary embodiment of the present disclosure. Here, a paper roll dampener 103 is shown installed in a paper roll 10 (e.g., here, a toilet paper roll). In particular, the paper roll 10 is installed on a dispenser bar 30, which here is locked on both ends, and the paper roll dampener 103 is inserted between the dispenser bar 30 and the paper roll 10, below the dispenser bar 30.

The paper roll dampener 103 may be sized and dimensioned so as to provide a drag or dampening force on the paper roll 10 that resists inadvertent rollout. In particular, here paper roll dampener 103 is arranged so as to interface with and apply a force to an inner surface of the paper roll 10. For example, here, the paper roll dampener 103 is embodied as rod having a uniform, round cross section and generally shaped in U-shape in a single plane. In other embodiments, the rod may be flattened, may have a non-round and/or non-uniform cross section, or any combination thereof.

Also, the paper roll dampener 103 may be substantially balanced such that its interfacing portion remains substantially horizontal when in use. In addition, the paper roll dampener 103 is configured to provide limited resistance, such that it will reset itself to a lowest radial position of the inner surface of the paper roll 10 upon being rotationally displaced beyond a predetermined threshold, as discussed below.

Figure 2:
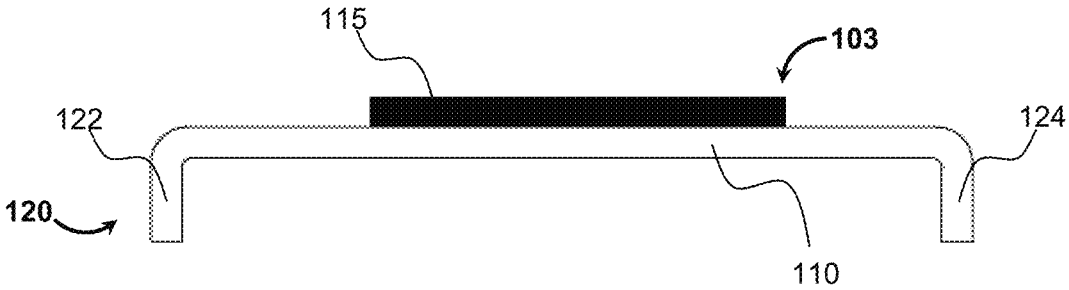
FIG. 2 is a schematic diagram of the paper roll dampener, according to an embodiment of the present disclosure.

FIG. 2 is a schematic diagram of the paper roll dampener, according to an embodiment of the present disclosure. As shown, the paper roll dampener 103 may include a roll interface 110, a dampener weight 115 coupled to the roll interface 110, and a roll retainer 120 coupled to the roll interface 110. As above, the roll interface 110 is configured to interface with the inner surface of the paper roll 10 (FIG. 1) with sufficient contact surface and friction to resist inadvertent rollout, yet allow the paper roll dampener 103 to automatically reset itself to a lowest radial position upon being displaced beyond the predetermined threshold. According to one embodiment, the roll interface 110 may have a length that is approximately that of a cylindrical height of the paper roll 10, or slightly greater.

Here, for clarity, the dampener weight 115 is conveniently illustrated as a discrete element, however it should be understood that the dampener weight 115 generally includes the entire weight of the entire paper roll dampener 103, and may be distributed throughout.

The roll interface 110 may be configured to use gravity-generated friction via the dampener weight 115 for resistance against rolling. The roll interface 110 may be further configured to permit rolling once a threshold condition is met for the particular paper roll to be dampened. In particular, the roll interface 110 may have a surface roughness or roll interfacing structural features (e.g., geometrical protrusions) that resists rotation until the roll interface 110 is rotated to a predetermined rotation angle of the roll. Resistance may be in the form of a friction couple that creates a resistive energy potential as the dampener weight 115 is elevated, and/or kinetic friction against rolling (e.g. when the dampener weight 115 is elevated to the predetermined threshold.

To illustrate the predetermined threshold, the resistive friction of the roll interface 110 may be overcome once the roll interface 110 has rotated with the paper roll 10 to a release angle (e.g., less than 45 degrees, 45 degrees to 5 degrees, 30 degrees to 10 degrees, or approximately 15 degrees) from bottom dead center (BDC).

The roll retainer 120 is configured to permit the roll interface 110 to enter the inner surface of the paper roll 10 and lock into place, for example by rotating 90 degrees, inserting axially, passing out the opposite end, and releasing. Preferably, the roll retainer 120 is configured to permit the roll interface 110 to enter the inner surface of the paper roll 10 while the paper roll 10 is installed on its respective dispenser bar 30, and further to lock into place via gravity (e.g., via inertia when released). The roll retainer 120 may include a first end retainer 122 and a second end retainer 124, where the first end retainer 122 and the second end retainer 124 are configured to prevent or otherwise inhibit unintentional separation of the paper roll dampener 103 from the paper roll 10 once installed. For example, one or both of the first end retainer 122 and the second end retainer 124 may include an arm, tab, lip, end cap and the like, which are inertially balanced so as to point downward when released or otherwise in a free state.

Figure 3:
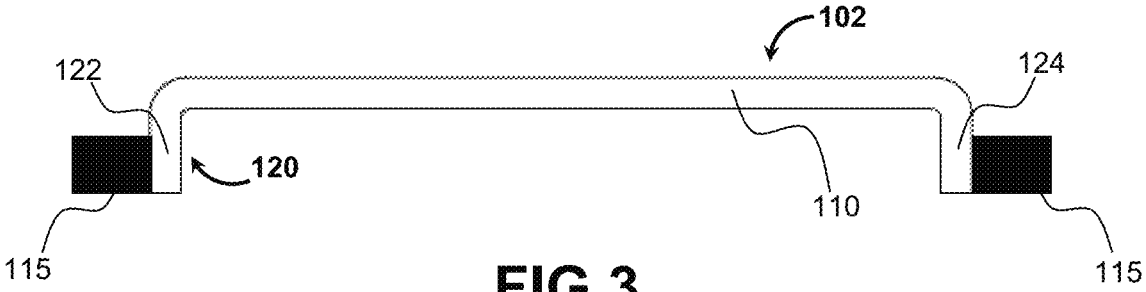
FIG. 3 is a schematic diagram of the paper roll dampener, according to another embodiment of the present disclosure.

FIG. 3 is a schematic diagram of paper roll dampener, according to an embodiment of the present disclosure. According to the illustrated embodiment, the dampener weight 115 may be distributed or separated. As discussed above, the dampener weight 115 generally includes the entire weight of entire paper roll dampener 102, however here the dampener weight 115 may include discrete concentrations on opposing ends of the paper roll dampener 10, with respect to opposing ends of the paper roll 10 (FIG. 1). In particular, each concentration of dampener weight 115 may be strategically positioned below and installed horizontal so as to create or augment a gravity returning force when the roll retainer 120 is rotated from its locked orientation.

Figure 4:
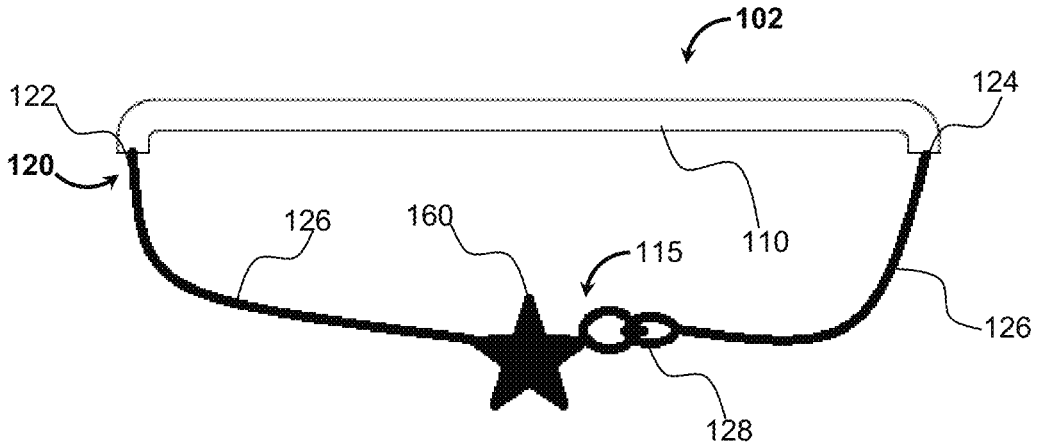
FIG. 4 is a schematic diagram of the paper roll dampener, according to yet another embodiment of the present disclosure.

FIG. 4 is a schematic diagram of the paper roll dampener, according to yet another embodiment of the present disclosure. As above, paper roll dampener 102 may include the roll interface 110, the dampener weight 115, and the roll retainer 120. The paper roll dampener 102 may further include an ornament 160 coupled to the roll interface 110. The ornament 160 is conveniently illustrated as a "star", but may be any ornamental item. According to one embodiment, the dampener weight 115 (e.g., when treated as a discrete item) may be integrated with the ornament 160.

According to one embodiment, the roll retainer 120 may include a flexible member 126 (e.g., chain, cable, etc.) that is separable. In particular, the roll retainer 120 flexible member 126 may extend from opposing ends of the roll interface 110 and be releasably joined by clasp 128 or other toolless coupling. As shown, separate ends of the flexible member 126 may extend from the first end retainer 122 and the second end retainer 124, respectively, with the ornament 160 interspersed or otherwise coupled there between.

Figure 5:
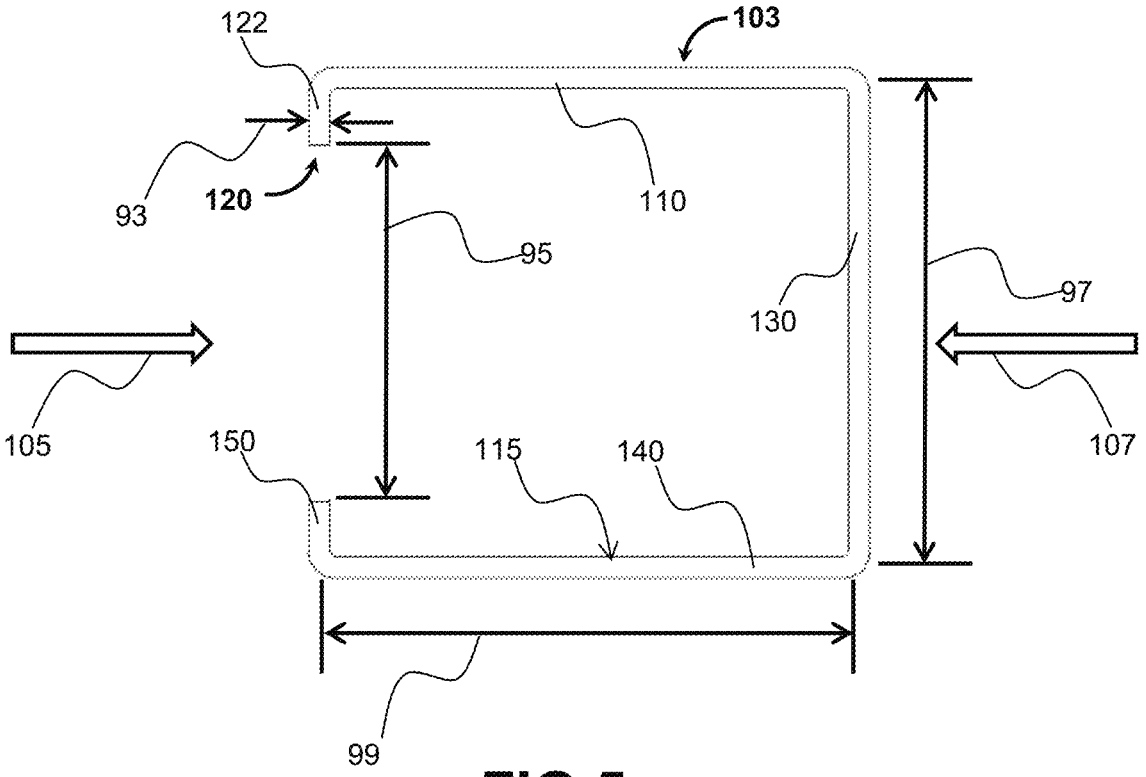
FIG. 5 is a side view of the paper roll dampener of FIG. 1, according to an exemplary embodiment of the present disclosure.
Figure 6:
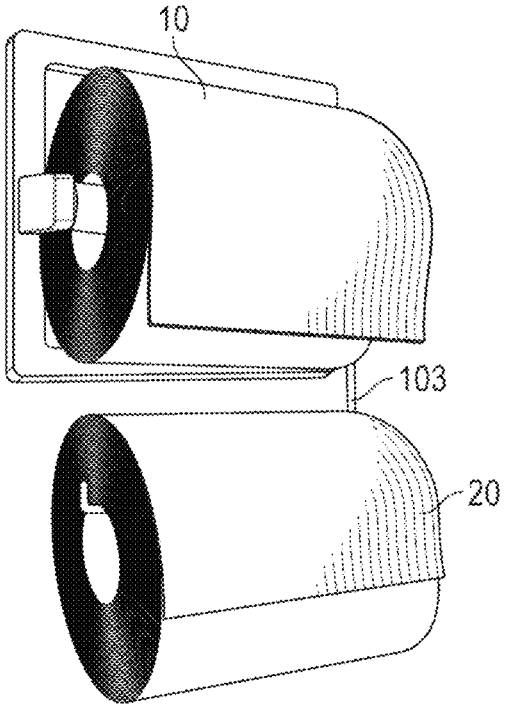
FIG. 6 is a first perspective view of the paper roll dampener of FIG. 1 in an in-use condition.
Figure 7:
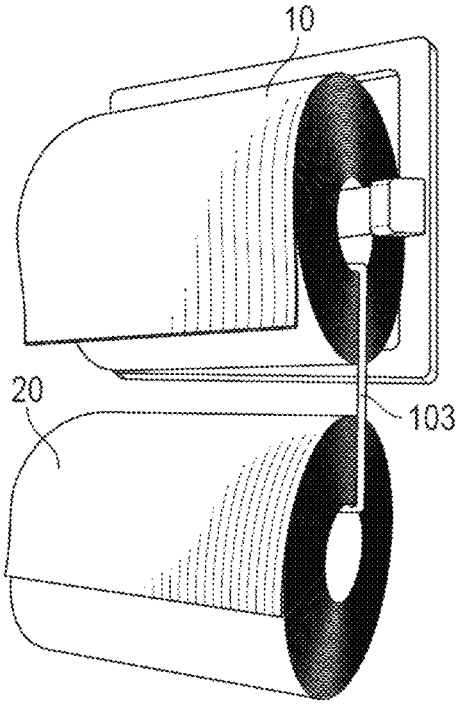
FIG. 7 is a second, opposing perspective view of the paper roll dampener of FIG. 1 in an in-use condition.

FIG. 5 is a side view of the paper roll dampener of FIG. 1, according to an exemplary embodiment of the present disclosure. FIG. 6 is a first perspective view of the paper roll dampener of FIG. 1 in an in-use condition. FIG. 7 is a second, opposing perspective view of the paper roll dampener of FIG. 1 in an in-use condition. As above, paper roll dampener 103 may include the roll interface 110, the dampener weight 115, and the first end retainer 122. Likewise, the dampener weight 115 may be distributed throughout the paper roll dampener 103. As shown here, the paper roll dampener 103 may be configured to hang from the paper roll 10 and to support the spare paper roll 20 therefrom.

In this embodiment, the paper roll dampener 103 is insertable into the paper roll 10 from one side, and has an insertion side 105 and a terminal side 107 opposite the insertion side 105. As shown, the insertion side 105 generally corresponds to a side that first enters the paper roll 10 or the spare paper roll 20 when installed, and the terminal side 107 generally corresponds to a termination to which the paper roll dampener 103 can no longer enter the paper roll 10.

As shown, the paper roll dampener 103 may further include an extension member 130, a spare roll bar 140, and a spare roll retainer 150. Together the extension member 130, the spare roll bar 140, and the spare roll retainer 150 are configured to hold the spare paper roll 20 (e.g., an extra toilet paper roll) below the paper roll 10 installed on the dispenser bar 30 when the paper roll dampener 103 is installed in the paper roll 10.

The extension member 130 is coupled to the roll interface 110 at or about the terminal side 107 and may form part of the roll retainer 120 (e.g., on the terminal side 107). As shown, the extension member 130 extends away from the roll interface 110 by a separation height 97. According to one embodiment the extension member 130 and the roll interface 110 may be arranged orthogonal to each other.

According to one embodiment, the separation height 97 may be sufficient to hold the paper roll 10 and the spare paper roll 20 at the same time, diameter-to-diameter. It is understood that there may be variation between different types of paper rolls and even between the same types of paper rolls. For illustration purposes, here a reference toilet paper roll may have an inner diameter of 1.75 inches, an outer diameter of 4.5 inches, and a cylindrical height of 4.5 inches. Accordingly, for use with the reference toilet paper roll, the separation height 97 may be between 3 inches and 8 inches, between 4 inches and 5 inches, between 4.0 inches and 4.5 inches, or approximately 4.2 inches The spare roll bar 140 is coupled to the extension member 130 opposite the roll interface 110 at or about the terminal side 107 of the spare roll bar 140. Similar to the roll interface 110, the spare roll bar 140 is configured to interface with an inner surface of the spare paper roll 20, however, rather than hanging from the spare paper roll 20, the spare roll bar 140 is configured to support the spare paper roll 20 therefrom. According to one embodiment, the spare roll bar 140 may extend parallel to the roll interface 110.

In addition, the spare roll bar 140 may extend from the extension member 130 by a dispenser length 99. The dispenser length 99 may be approximately that of a cylindrical height of the spare paper roll 20 (also paper roll 10), or slightly greater. For example, for use with the reference toilet paper, the dispenser length 99 may be between 4 inches and 6 inches, between 4.5 inches and 5 inches, or approximately 4.7 inches. It is understood that these relative sizes and dimensions may vary relative to the paper role being dampened. According to one embodiment, the spare roll bar 140 and the extension member 130 may be arranged orthogonal to each other. According to another embodiment, the spare roll bar 140, the extension member 130, and the roll interface 110 may be arranged coplanar to each other. According to yet another embodiment, the spare roll bar 140, the extension member 130, and the roll interface 110 may be arranged coplanar to each other.

The spare roll retainer 150 is configured to permit the spare roll bar 140 to enter the inner surface of the spare paper roll 20 and lock into place, for example by inserting axially, passing out the opposite end, and releasing. Preferably, the spare roll retainer 150 is configured to prevent or otherwise inhibit unintentional separation of the spare paper roll 20 from the paper roll dampener 103 once installed. For example, spare roll retainer 150 may include an arm, tab, lip, end cap and the like, which points upward when the paper roll dampener 103 hangs from the paper roll 10 in a free state. According to one embodiment, the spare roll retainer 150 may extend away from the spare roll bar 140 toward the roll interface 110 (e.g., "upward" when in use) by be between 0.25 inch and 1 inch, or approximately 0.5 inch.

According to another embodiment and as shown, the spare roll retainer 150 may mirror the first end retainer 122 on insertion side 105 such that they extend toward each other and away from the spare roll bar 140 and the roll interface 110, respectively, forming an insertion gap 95 there between. The insertion gap 95 may be sized and dimensioned to permit coupling with both the paper roll 10 and the spare paper roll 20. Accordingly, for use with toilet paper, the insertion gap 95 may be between 3 inches and 4 inches, between 3.0 inches and 3.5 inches, or approximately 3.2 inches.

According to one embodiment, the paper roll dampener 103 may be made of a single rod having a thickness 93. Also, the first end retainer 122, the roll interface 110, extension member 130, the spare roll bar 140, and the spare roll retainer 150 may be coupled in series in a "C" or "U' shape where its opening coincides with the insertion side 105. Further, the roll retainer 120, the roll interface 110, extension member 130, the spare roll bar 140, and the spare roll retainer 150 may be arranged at right angles to adjacent elements.

According to one preferred embodiment, and as shown, the paper roll dampener 103 may be made of a single rod having the thickness 93 and a series of bends (or otherwise formed) substantially in a "C" or "U' shape in a single plane, such that the first end retainer 122 is joined to the roll interface 110 at 90 degrees, the roll interface 110 is then joined to the extension member 130 at 90 degrees, the extension member 130 is then joined to the spare roll bar 140 at 90 degrees, and the spare roll bar 140 then is joined to the spare roll retainer 150 at 90 degrees. Thus here, the rod shape may provide a parallel arm (the spare roll bar 140)

under the braking arm (the roll interface 110) to which the spare paper roll 20 (or other weight) may be added for additional braking effect.

Further, the first end retainer 122 may have a length of approximately 0.5 inch, the roll interface 110 may have a length of approximately 4.65 inch, the extension member 130 may have a length of approximately 4.2 inch, the spare roll bar 140 may have a length of approximately 4.65 inch, and the spare roll retainer 150 may have a length of approximately 0.5 inch. Further, the thickness 93 may be approximately 0.2 inch. For example, the paper roll dampener 103 may be a metal U-shaped rod made of steel (e.g., 0.201 Dia low carbon steel, minimum burr), which will far outlast foam inserts.

Benefits of this embodiment, and others throughout the present disclosure, may include: stopping excessive unrolling of toilet paper, stopping waste, saving trees, saving the environment, saving the aggravation of re-reeling the paper after pets or children have played with it. It should be recognized that the lower arm for the second roll is configured to serve 2 separate functions: (a) to allow the second roll to provide increased weight, pulling down on the primary roll to increase anti-unrolling friction, and (b) to provide a backup roll when the primary roll is depleted. The utility for some users may be primarily the ready availability of a backup roll.

Figure 8:
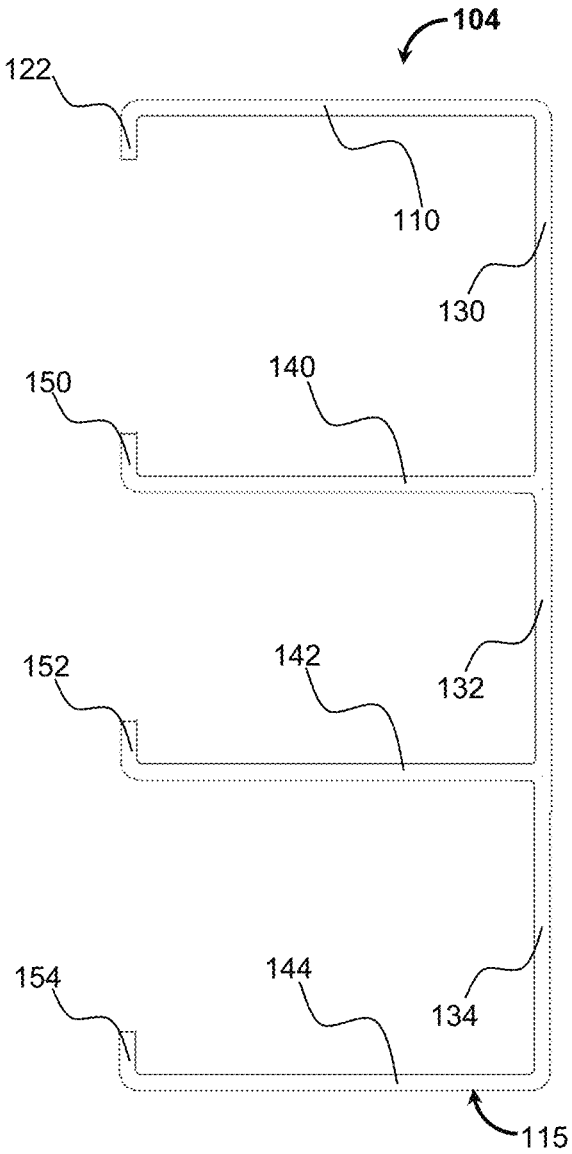
FIG. 8 is a side view of the paper roll dampener, according to another exemplary embodiment of the present disclosure.

FIG. 8 is a side view of the paper roll dampener, according to another exemplary embodiment of the present disclosure. As above, paper roll dampener 104 may include the first end retainer 122, the roll interface 110, the dampener weight 115, the extension member 130, the spare roll bar 140, and the spare roll retainer 150. Likewise, the dampener weight 115 may be distributed throughout the paper roll dampener 104. As shown here, the paper roll dampener 104 may be configured to hang from the paper roll 10 (FIG. 6) and to support a plurality of spare paper rolls 20 (FIG. 6) therefrom.

As shown, the paper roll dampener 104 may further include a plurality of support rungs for the plurality of spare paper rolls 20. In particular, the paper roll dampener 104 may further include an extra extension member 132, an extra spare roll bar 142, and an extra spare roll retainer 152. Together the extension member 130, the spare roll bar 140, and the spare roll retainer 150 are configured to hold another spare paper roll 20 (e.g., an extra toilet paper roll) below the spare paper roll 20 installed on the spare roll bar 140 when in use. The extra extension member 132, an extra spare roll bar 142, and an extra spare roll retainer 152 may be coupled and arranged the same or similarly as the above rung (i.e., the extension member 130, the spare roll bar 140, and the spare roll retainer 150), and coupled to the above rung, for example at a coupling or joint between the extension member 130, the spare roll bar 140. Additional rungs may be added in a similar manner, for example further including an nth extra extension member 134, an nth extra spare roll bar 144, and an nth extra spare roll retainer 154. Preferably the paper roll dampener 104 may be sized and dimensioned similar to the paper roll dampener 103 as discussed above and with respect to the type of paper roll being dampened.

Figure 9:
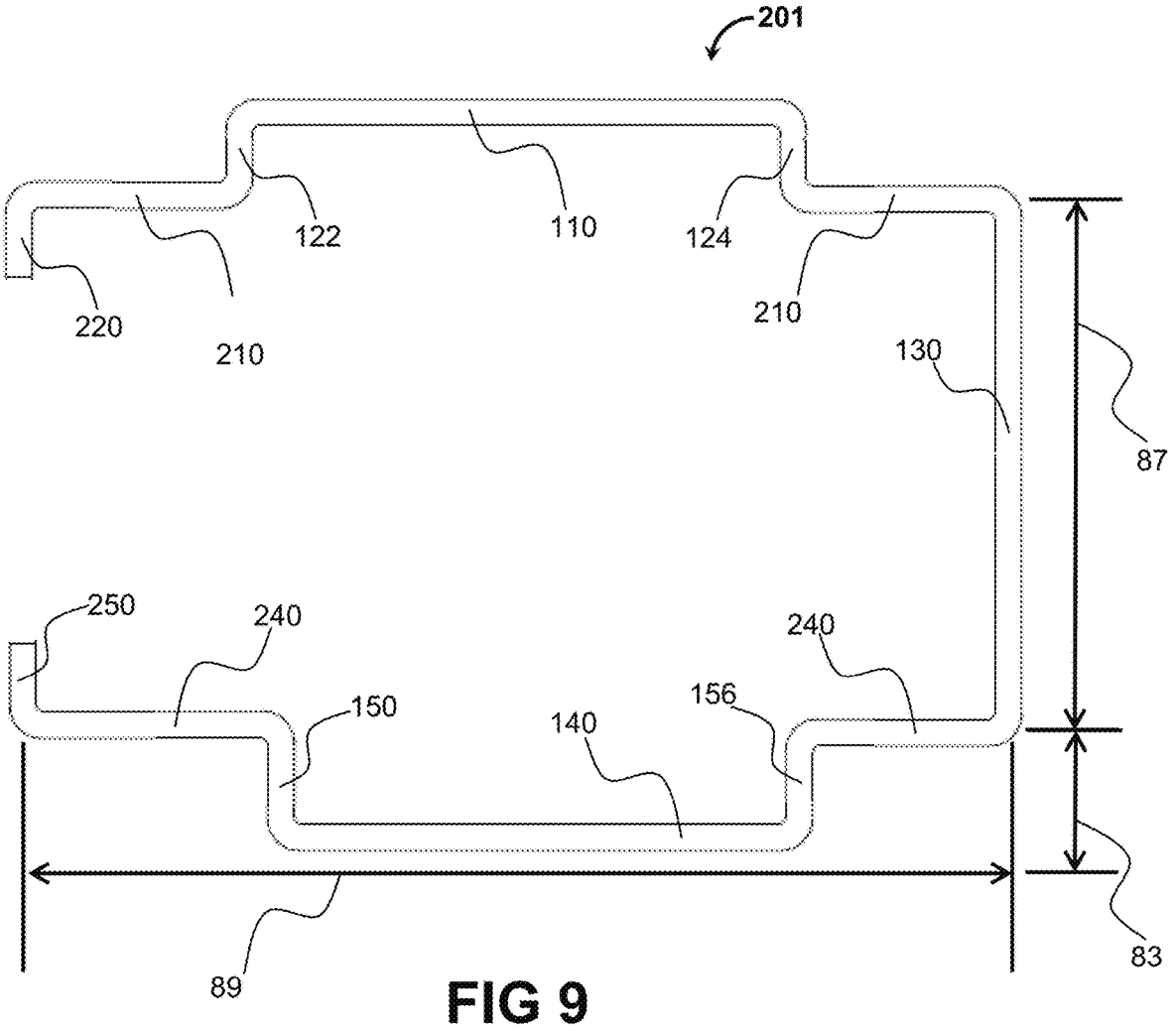
FIG. 9 is a side view of the paper roll dampener, according to yet another exemplary embodiment of the present disclosure.

FIG. 9 is a side view of the paper roll dampener, according to yet another exemplary embodiment of the present disclosure. Here, paper roll dampener 200 is configured to be used with a plurality of different sized rolls. For convenience, the paper roll dampener 200 is configured to be used with a shorter paper roll (e.g., toilet paper roll) and a longer paper roll (e.g., a paper towel), and their spares. As discussed above, additional rungs may be added.

As above, the paper roll dampener 200 may include the first end retainer 122, the roll interface 110, the second end retainer 124, and the dampener weight 115, together configured to dampen the shorter roll. Likewise, the dampener weight, 115 may be distributed throughout the paper roll dampener 200. The paper roll dampener 200 may further include the spare roll retainer 150, the spare roll bar 140, a second end spare roll retainer 156, and the extension member 130, together configured to support the spare shorter roll, with the second spare roll retainer 156 being analogous to the second end retainer 124, and with the extension member 130 coupling the rungs.

The paper roll dampener 200 may further include a longer roll retainer 220, a longer roll interface 210, an longer roll spare roll bar 240, and a longer roll spare roll retainer 250, together sized and dimensioned to dampen and support the longer roll and the longer spare roll, respectively, similar to paper roll dampener 103 (FIG. 5). For example, opposing ends of the longer roll interface 210 may define a first rung of the paper roll dampener 200, and opposing ends of the longer roll spare roll bar 240 may define a next rung of the paper roll dampener 200. The first and next rung may be coupled together via the extension member 130 at their terminal ends, respectively.

The first end retainer 122, the second end retainer 124, the spare roll retainer 150, and the second end spare roll retainer 156, may be characterized by a retention lip height 83 sufficient to retain the shorter roll (e.g., 0.5 inch). Similarly, the longer roll retainer 220 and the longer roll spare roll retainer 250, may be characterized by a height similar or equal to the retention lip height 83, which is also sufficient to retain the longer roll (e.g., 0.5 inch).

As with the paper roll dampener 103, at least one or both of the first and next rung may extend a longer dispenser length 89 that corresponds to the longer roll (e.g., at least 11 inches for an 11×11 inch paper towel). Similarly, the extension member 130 may extend or otherwise separate the first and next rungs by a max separation height 87 that corresponds to the greater diameter between the shorter paper roll and the longer paper roll (e.g., between 10 inches and 12 inches in the present example).

As shown, the longer roll interface 210 may be distributed about and coupled to opposing ends of the roll interface 110 via the first end retainer 122 and the second end retainer 124, together forming a first rung. Similarly, the longer roll spare roll bar 240 may be distributed about and coupled to opposing ends of the spare roll bar 140 via the spare roll retainer 150 and the second end spare roll retainer 156, together forming a next rung. Here, and throughout, the first rung and the next rung may be symmetric or otherwise balanced to minimize tilt from a horizontal orientation of the paper roll dampener during use. Further, where a plurality of roll sizes are accommodated, the paper roll dampener 200 may be configured such that the shorter roll is centered horizontally within the rung or the longer roll. According to one embodiment and similar to above, the paper roll dampener 200 may be made or otherwise formed from a single rod. Also as above, the rod may have any convenient cross section. Further, the paper roll dampener 200 (as well as the above embodiments) may include a wear resistant surface, such as a powder coat.

The above description of the various embodiments is provided to enable a person of ordinary skill in the art to make or use the subject matter of the disclosure. Various modifications to the embodiments will be readily apparent to those skilled in the art, and the generic principles defined herein may be applied to other variations without departing from the spirit or the scope of this disclosure. Thus, it is to be understood that the disclosure is not intended to be limited to the examples and designs described herein, which merely represent a presently preferred implementation of the disclosure, but that the disclosure is to be accorded the widest scope consistent with the principles and novel features disclosed herein. It is to be further understood that the scope of the present disclosure fully encompasses other embodiments that may become obvious to those skilled in the art.

The invention claimed is:

1. A device for inhibiting inadvertent unrolling of a paper roll while horizontally supported on a roller, the paper roll having an inner roll surface, said inner roll surface defining a center axis, a first roll end, a second roll end, and a cylindrical volume, the device comprising:

a roll interface configured to be axially inserted into the cylindrical volume of the paper roll while horizontally supported on the roller, and to interface directly with the inner roll surface of the paper roll with sufficient contact surface and friction to resist an inadvertent rollout of the paper roll, yet allow the device to automatically reset itself by sliding to a lowest radial position of the inner roll surface upon being displaced beyond a predetermined threshold;

a dampener weight coupled to the roll interface; and a roll retainer coupled to the roll interface, the roll retainer including a first end retainer and a second end retainer, the first end retainer and the second end retainer configured to inhibit axial movement via braking against the first roll end and the second roll end of the paper roll once installed; and wherein the roll interface, the first end retainer, and the second end retainer are each defined as an elongated member that is elongated along a rod axis and has a substantially constant cross-section perpendicular to said rod axis, the cross-section of the first end retainer and the second end retainer substantially similar to each other and to the cross-section of the roll retainer.

2. The device of claim 1, wherein the roll interface, the dampener weight, and the roll retainer are together made from a single, shaped rod, said rod being shaped such that the rod axis of the roll interface intersects the rod axis of each of the first end retainer and the second end retainer, respectively; and wherein the dampener weight is defined as a weight of the entire device and is distributed throughout the shaped rod.

3. The device of claim 2, wherein each elongated member is made of powder coated steel.

4. The device of claim 1, wherein the roll interface linearly extends from the first end retainer in an "L" shape; and wherein the second end retainer linearly extends from the roll interface in an "L" shape, opposite and in-plane with the first end retainer.

5. The device of claim 4, further comprising:

an extension member linearly extending inline from the second end retainer, opposite and away from the roll interface;

a spare roll bar linearly extending from the extension member in an "L" shape, opposite and in-plane with the second end retainer; and a spare roll retainer linearly extending from the spare roll bar in an "L" shape, opposite and in-plane with the extension member; and wherein the extension member, the spare roll bar, and the spare roll retainer are each defined as an elongated member that is elongated along a rod axis and has a substantially constant cross-section perpendicular to said rod axis, the cross-sections of the extension member, the spare roll bar, and the spare roll retainer substantially similar to each other, and substantially similar to the cross-sections of the first end retainer, the second end retainer, and the roll retainer, respectively.

6. The device of claim 5, wherein the spare roll bar and the spare roll retainer are sized and dimensioned to slide into and through the cylindrical volume from the first roll end, along a center axis, to the second roll end of the paper roll, and to support a similarly sized spare paper roll therefrom; and wherein the extension member has a separation height measured between the roll interface and the spare roll bar that is at least that of an outer diameter of the paper roll.

7. The device of claim 6, In addition, the spare roll bar has a dispenser length measured between the extension member and the spare roll retainer, the dispenser length being at least that of a cylindrical height of the paper roll.

8. The device of claim 7, wherein the first end retainer and the spare roll retainer each have a length of approximately 0.5 inch;

wherein the separation height is between 3 inches and 8 inches; and wherein the dispenser length is between 4 inches and 6 inches.

9. The device of claim 6, further comprising:

an extra extension member integrated with and linearly extending inline from the extension member, and opposite the second end retainer;

an extra spare roll bar linearly extending from the extra extension member in an "L" shape, opposite the extension member and in-plane with the spare roll bar; and an extra spare roll retainer linearly extending from the extra spare roll bar in an "L" shape, opposite and in-plane with the extra extension member; and wherein extra the spare roll bar and the extra spare roll retainer are sized and dimensioned to slide into and through the cylindrical volume from the first roll end, along a center axis, to the second roll end of the paper roll, and to support a similarly sized extra spare paper roll therefrom.

10. The device of claim 5, wherein the spare roll bar and the spare roll retainer mirror the roll interface and the roll retainer, respectively, from opposite ends of the extension member.

11. The device of claim 1, wherein the roll retainer includes a separable flexible member that extends from opposing ends of the roll interface and is releasably joined by a toolless coupling.

12. A toilet paper roll dampener for inhibiting inadvertent unrolling of a toilet paper roll while horizontally supported on a roller, the toilet paper roll having an inner roll surface, said inner roll surface defining a center axis, a first roll end, a second roll end, and a cylindrical volume, the toilet paper roll dampener comprising:

a roll interface configured to be axially inserted into the cylindrical volume of the toilet paper roll while horizontally supported on the roller, and to interface directly with the inner roll surface of the toilet paper roll with sufficient contact surface and friction to resist an inadvertent rollout of the toilet paper roll, yet allow the device to automatically reset itself by sliding to a lowest radial position of the inner roll surface upon being displaced beyond a predetermined threshold;

a dampener weight coupled to the roll interface; and a roll retainer coupled to the roll interface, the roll retainer including a first end retainer and a second end retainer, the first end retainer and the second end retainer configured to inhibit axial movement via braking against the first roll end and the second roll end of the toilet paper roll once installed; and wherein the roll interface, the first end retainer, and the second end retainer are each defined as an elongated member that is elongated along a rod axis and has a substantially constant cross-section perpendicular to said rod axis, the cross-section of the first end retainer and the second end retainer substantially similar to each other and to the cross-section of the roll retainer.

13. The toilet paper roll dampener of claim 12, further comprising:

an extension member linearly extending inline from the second end retainer, opposite and away from the roll interface;

a spare roll bar linearly extending from the extension member in an "L" shape, opposite and in-plane with the second end retainer; and a spare roll retainer linearly extending from the spare roll bar in an "L" shape, opposite and in-plane with the extension member; and wherein, wherein the roll interface linearly extends from the first end retainer in an "L" shape; and wherein the second end retainer linearly extends from the roll interface in an "L" shape, opposite and in-plane with the first end retainer; and wherein the extension member, the spare roll bar, and the spare roll retainer are each defined as an elongated member that is elongated along a rod axis and has a substantially constant cross-section perpendicular to said rod axis, the cross-sections of the extension member, the spare roll bar, and the spare roll retainer substantially similar to each other, and substantially similar to the cross-sections of the first end retainer, the second end retainer, and the roll retainer, respectively;

wherein the roll interface, the dampener weight, the roll retainer, the extension member, the spare roll bar, and the spare roll retainer are together made from a single, shaped, steel rod, said steel rod being shaped such that the rod axis of the roll interface intersects the rod axis of each of the first end retainer and the second end retainer, respectively, such that the rod axis of spare roll bar intersects the rod axis of each of the extension member and the spare roll retainer, respectively, and such that the rod axis of the second end retainer is concentric with the rod axis of the extension member; and wherein the dampener weight is defined as a weight of the entire device and is distributed throughout the shaped steel rod.

14. The device of claim 13, wherein the spare roll bar and the spare roll retainer are sized and dimensioned to slide into and through the cylindrical volume from the first roll end, along a center axis, to the second roll end of the toilet paper roll, and to support a similarly sized spare toilet paper roll therefrom; and wherein the extension member has a separation height measured between the roll interface and the spare roll bar that is at least that of an outer diameter of the toilet paper roll.

15. The device of claim 14, wherein the spare roll bar and the spare roll retainer mirror the roll interface and the roll retainer, respectively, from opposite ends of the extension member.

16. A paper towel roll dampener for inhibiting inadvertent unrolling of a paper towel roll while horizontally supported on a roller, the paper towel roll having an inner roll surface, said inner roll surface defining a center axis, a first roll end, a second roll end, and a cylindrical volume, the paper towel roll dampener comprising:

a roll interface configured to be axially inserted into the cylindrical volume of the paper towel roll while horizontally supported on the roller, and to interface directly with the inner roll surface of the paper towel roll with sufficient contact surface and friction to resist an inadvertent rollout of the paper towel roll, yet allow the device to automatically reset itself by sliding to a lowest radial position of the inner roll surface upon being displaced beyond a predetermined threshold;

a dampener weight coupled to the roll interface; and a roll retainer coupled to the roll interface, the roll retainer including a first end retainer and a second end retainer, the first end retainer and the second end retainer configured to inhibit axial movement via braking against the first roll end and the second roll end of the paper towel roll once installed; and wherein the roll interface, the first end retainer, and the second end retainer are each defined as an elongated member that is elongated along a rod axis and has a substantially constant cross-section perpendicular to said rod axis, the cross-section of the first end retainer and the second end retainer substantially similar to each other and to the cross-section of the roll retainer.

17. The paper towel roll dampener of claim 16, further comprising:

an extension member linearly extending inline from the second end retainer, opposite and away from the roll interface;

a spare roll bar linearly extending from the extension member in an "L" shape, opposite and in-plane with the second end retainer; and a spare roll retainer linearly extending from the spare roll bar in an "L" shape, opposite and in-plane with the extension member; and wherein the extension member, the spare roll bar, and the spare roll retainer are each defined as an elongated member that is elongated along a rod axis and has a substantially constant cross-section perpendicular to said rod axis, the cross-sections of the extension member, the spare roll bar, and the spare roll retainer substantially similar to each other, and substantially similar to the cross-sections of the first end retainer, the second end retainer, and the roll retainer, respectively;

wherein, wherein the roll interface linearly extends from the first end retainer in an "L" shape;

wherein the second end retainer linearly extends from the roll interface in an "L" shape, opposite and in-plane with the first end retainer; and wherein the roll interface, the dampener weight, the roll retainer, the extension member the spare roll bar, and the spare roll retainer are together made from a single, shaped, steel rod, said steel rod being shaped such that the rod axis of the roll interface intersects the rod axis of each of the first end retainer and the second end retainer, respectively, such that the rod axis of spare roll bar intersects the rod axis of each of the extension member and the spare roll retainer, respectively, and such that the rod axis of the second end retainer is concentric with the rod axis of the extension member; and wherein the dampener weight is defined as a weight of the entire device and is distributed throughout the shaped steel rod.

18. The device of claim 17, wherein the spare roll bar and the spare roll retainer are sized and dimensioned to slide into and through the cylindrical volume from the first roll end, along a center axis, to the second roll end of the paper towel roll, and to support a similarly sized spare paper towel roll therefrom; and wherein the extension member has a separation height measured between the roll interface and the spare roll bar that is at least that of an outer diameter of the paper towel roll.

19. The device of claim 18, wherein the spare roll bar and the spare roll retainer mirror the roll interface and the roll retainer, respectively, from opposite ends of the extension member.

* * * * *